US010345052B2

(12) United States Patent
Cho

(10) Patent No.: US 10,345,052 B2
(45) Date of Patent: Jul. 9, 2019

(54) POROUS MEDIA EVAPORATOR

(71) Applicant: Hamilton Sundstrand Corporation, Charlotte, NC (US)

(72) Inventor: Wei-Lin Cho, Unionville, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 5 days.

(21) Appl. No.: 15/387,116

(22) Filed: Dec. 21, 2016

(65) Prior Publication Data

US 2018/0172326 A1 Jun. 21, 2018

(51) Int. Cl.

| | |
|---|---|
| ***F25B 39/00*** | (2006.01) |
| ***F28F 13/00*** | (2006.01) |
| ***F25B 39/02*** | (2006.01) |
| ***F28D 7/10*** | (2006.01) |
| ***F28D 15/04*** | (2006.01) |
| *F25B 23/00* | (2006.01) |
| *F25B 43/00* | (2006.01) |
| *F28D 21/00* | (2006.01) |

(52) U.S. Cl.

CPC ..... *F28F 13/003* (2013.01); *F25B 39/02* (2013.01); *F28D 7/106* (2013.01); *F28D 15/046* (2013.01); *F25B 23/006* (2013.01); *F25B 43/00* (2013.01); *F28D 2021/0064* (2013.01); *F28D 2021/0071* (2013.01); *F28D 2021/0085* (2013.01)

(58) Field of Classification Search

CPC ..... F25B 39/02; F25B 23/006; F25B 43/00; F28D 15/043; F28D 15/0266; F28D 2021/0064; F28D 7/106; F28F 13/187; F28F 13/003

See application file for complete search history.

(56) References Cited

U.S. PATENT DOCUMENTS 4,470,450 A * 9/1984 Bizzell ..... F28D 15/043 165/104.25
4,869,313 A 9/1989 Fredley
4,934,160 A 6/1990 Mueller
(Continued)

FOREIGN PATENT DOCUMENTS

CN 101311662 11/2008
EP 0210337 2/1987
(Continued)

OTHER PUBLICATIONS

European Patent Office, European Partial Search Report dated May 3, 2018 in Application No. 17206833.0-1008.
(Continued)

*Primary Examiner* — Frantz F Jules
*Assistant Examiner* — Lionel Nouketcha
(74) *Attorney, Agent, or Firm* — Snell & Wilmer L.L.P.

(57) ABSTRACT

An evaporator includes a housing having a liquid inlet interface, a liquid outlet interface, and a vapor outlet interface. The evaporator also includes, according to various embodiments, a porous media disposed in the housing and having a porous wall that defines a conduit. The conduit defined in the porous media may be in fluidic communication between the liquid inlet interface and the liquid outlet interface of the housing. Also, fluidic communication between the conduit defined in the porous media and the vapor outlet interface of the housing may be through the porous wall of the porous media.

15 Claims, 6 Drawing Sheets

(56) References Cited

U.S. PATENT DOCUMENTS

| | | | | |
|---|---|---|---|---|
| 6,672,377 | B2 * | 1/2004 | Liu | F28D 7/106 165/154 |
| 6,840,304 | B1 * | 1/2005 | Kobayashi | B01D 3/007 165/104.25 |
| 7,661,464 | B2 * | 2/2010 | Khrustalev | F28D 15/043 165/104.21 |
| 7,931,072 | B1 | 4/2011 | Kroliczek et al. | |
| 8,061,413 | B2 * | 11/2011 | Turner | B01D 7/02 165/104.26 |
| 8,567,486 | B1 * | 10/2013 | Wolf, Sr. | F28D 15/0266 165/104.22 |
| 2004/0182550 | A1 * | 9/2004 | Kroliczek | F25B 23/006 165/104.26 |
| 2007/0131388 | A1 | 6/2007 | Khrustalev | |
| 2012/0137718 | A1 * | 6/2012 | Uchida | H05K 7/20336 62/259.2 |
| 2013/0167517 | A1 | 7/2013 | Duepmeier | |
| 2014/0137581 | A1 * | 5/2014 | Cho | F25B 39/028 62/119 |

FOREIGN PATENT DOCUMENTS

| | | |
|---|---|---|
| JP | 0755374 | 3/1955 |
| WO | 9604517 | 2/1996 |

OTHER PUBLICATIONS

European Patent Office, European Search Report dated Aug. 7, 2018 in Application No. 17206833.0-1008.

* cited by examiner

POROUS MEDIA EVAPORATOR

FIELD

The present disclosure relates to heat exchangers and, more specifically, to evaporator components of heat exchangers.

BACKGROUND

Heat exchangers are used in a variety of applications. Single phase liquid heat exchangers, for example, are often used to cool and/or heat components of a system. In such heat exchangers, a liquid is pumped across a component and sensible heat is transferred between the liquid and the component and thus the liquid changes temperature. These heat exchangers rely on the sensible heat capacity of the liquid to transfer heat. However, these single phase heat exchangers often require large volumes of liquid, which can increase the overall operating costs of a heat exchanger system.

SUMMARY

In various embodiments, the present disclosure provides an evaporator that includes a housing having a liquid inlet interface, a liquid outlet interface, and a vapor outlet interface. The evaporator also includes, according to various embodiments, a porous media disposed in the housing and having a porous wall that defines a conduit. The conduit defined in the porous media may be in fluidic communication between the liquid inlet interface and the liquid outlet interface of the housing. Also, fluidic communication between the conduit defined in the porous media and the vapor outlet interface of the housing may be through the porous wall of the porous media.

In various embodiments, the porous wall includes pores that have an average pore size diameter of between about 1.0 micrometer and about 5.0 micrometers. The porous media may be cylindrical and the porous wall may be a porous tube that has a radially outward surface and a radially inward surface facing and bordering the conduit. In various embodiments, the porous tube includes a porous ceramic material. The conduit may extend along a longitudinal centerline axis of the porous tube and the radially outward surface may be in direct contact with an internal surface of the housing. The radially outward surface may also include a longitudinally extending vapor vent channel. The longitudinally extending vapor vent channel may be one of a plurality of longitudinally extending vapor vent channels that are circumferentially distributed across the radially outward surface of the porous tube. In various embodiments, the longitudinally extending the vapor vent channel is configured to direct vapor to the vapor outlet interface. In various embodiments, the radially outward surface of the porous tube includes a plurality of circumferentially extending vapor grooves.

The porous tube, according to various embodiments, includes a multi-layer mesh material. The radially outward surface of the porous tube may be in direct contact with a plurality of radially extending fins of an internal surface of the housing. Vapor may be configured to flow between adjacent fins of the plurality of radially extending fins to the vapor outlet interface. In various embodiments, the porous tube includes an inlet end coupled to the liquid inlet interface and an outlet end coupled to the liquid outlet interface. The inlet end of the porous tube may overlap at least a portion of the liquid inlet interface and the outlet end of the porous tube may overlap at least a portion of the liquid outlet interface.

In various embodiments, the vapor outlet interface is a first vapor outlet interface disposed adjacent the inlet end of the porous tube and the evaporator includes a second vapor outlet interface disposed adjacent the outlet end of the porous tube. In various embodiments, the evaporator further includes a heat source interface coupled to the housing, wherein heat is configured to conduct from the heat source interface through the housing to liquid flowing through the conduit.

Also disclosed herein, according to various embodiments, is a porous media for an evaporator. The porous media may include a porous tube having a radially inward surface and a radially outward surface. The radially inward surface may face and border a conduit that extends along a longitudinal centerline axis of the porous tube and the radially outward surface may include a longitudinally extending vapor vent channel. In various embodiments, the radially outward surface includes a plurality of circumferentially extending vapor grooves. The longitudinally extending vapor vent channel may be one of a plurality of longitudinally extending vapor vent channels.

Also disclosed herein, according to various embodiments, is a heat exchanger system. The heat exchanger system may include a pump, a heat source interface, and an evaporator. The evaporator may include a liquid inlet interface configured to be in liquid receiving communication with the pump, a liquid outlet interface, a porous media having a porous wall and defining a conduit, wherein the conduit is disposed between the liquid inlet interface and the liquid outlet interface and the porous wall is configured to be in heat receiving communication with the heat source interface. The evaporator may also include a vapor outlet interface configured to be in vapor receiving communication with the porous wall and a valve downstream from the liquid outlet interface and configured to control back pressure in the evaporator.

In various embodiments, flow of vapor through the vapor outlet interface is configured to be controlled by the valve. In various embodiments, the evaporator is one of a plurality of evaporators and the valve is configured to control back pressure in the plurality of evaporators.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1A:
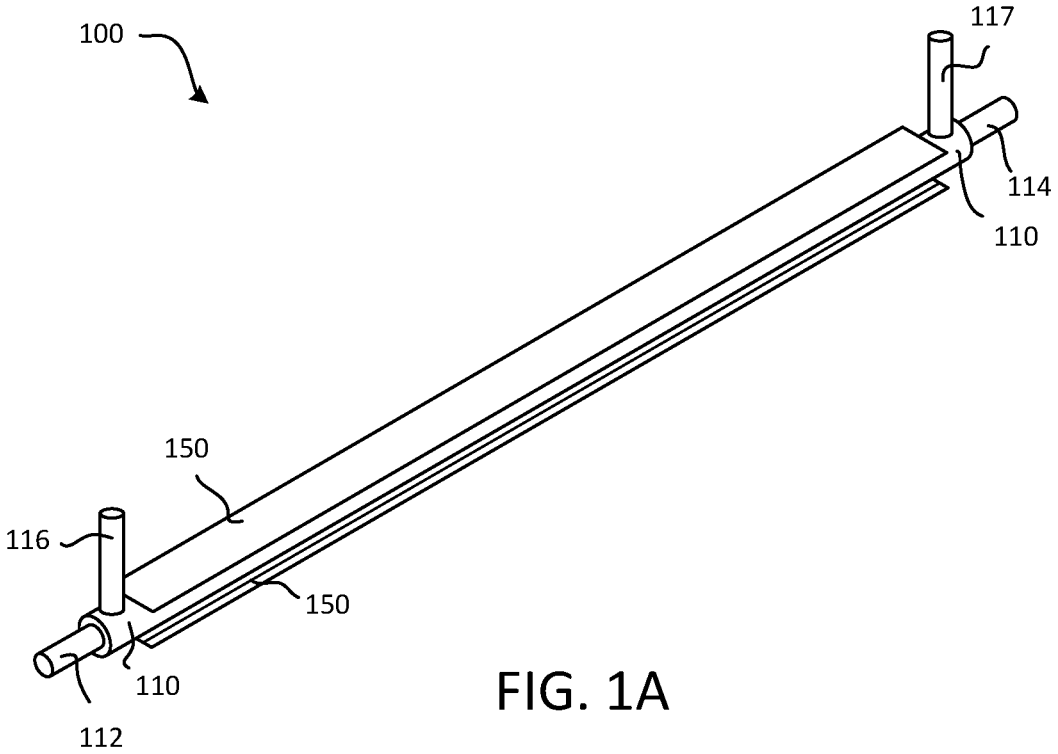
FIG. 1A illustrates a perspective view of an evaporator, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation. Throughout the present disclosure, like reference numbers denote like elements.

A first component that is "axially outward" of a second component means that a first component is positioned at a greater distance in either longitudinal direction away from the longitudinal center of the composite component along its longitudinal axis than the second component. A first component that is "axially inward" of a second component means that the first component is positioned closer to the longitudinal center of the composite component along its longitudinal axis than the second component.

A first component that is "radially outward" of a second component means that the first component is positioned at a greater distance away from the longitudinal centerline axis of the composite component than the second component. A first component that is "radially inward" of a second component means that the first component is positioned closer to the longitudinal centerline axis of the composite component than the second component.

Figure 1B:
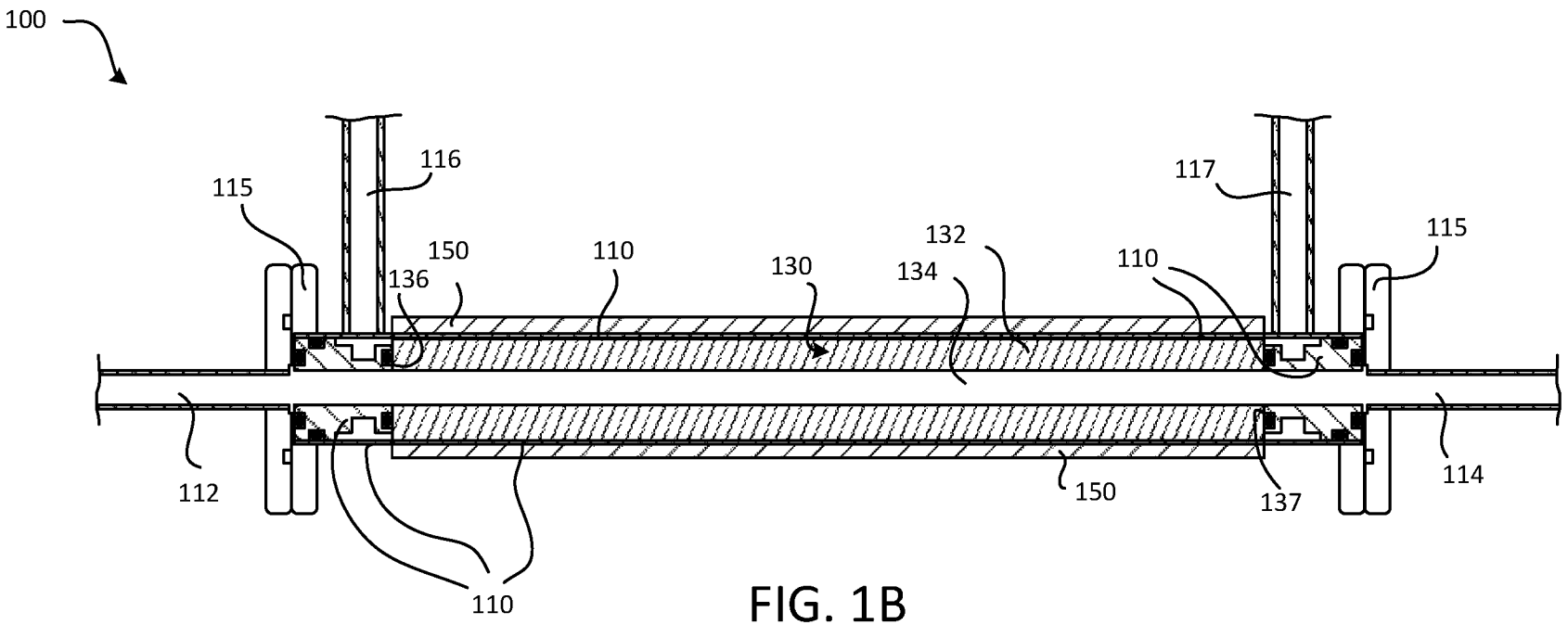
FIG. 1B illustrates a cross-sectional view of the evaporator of FIG. 1A showing a porous media, in accordance with various embodiments.

Disclosed herein, according to various embodiments and with reference to FIGS. 1A and 1B, is an evaporator 100 that includes a housing 110 and a porous media 130. Generally, the housing 110 includes a liquid inlet interface 112, a liquid outlet interface 114, and a vapor outlet interface 116. As described in greater detail below, the housing 110 may include multiple vapor outlet interfaces 116, 117. The porous media 130 is generally disposed in the housing 110 and includes a porous wall and defines a conduit 134. The porous wall, as described in greater detail below and according to various embodiments, includes a plurality of pores that extend radially outward from the conduit 134.

In various embodiments, the porous media 130 is generally positioned within the housing 110 so that the conduit 134 is in fluidic communication between the liquid inlet interface 112 and the liquid outlet interface 114. In various embodiments, fluidic communication between the conduit 134 and the vapor outlet interface 116 is through the porous wall of the porous media 130. In other words, and according to various embodiments, fluid communication between the conduit 134 and the vapor outlet interface 116 is limited/restricted to the pores of the porous wall.

In operation, liquid is generally pumped into the conduit 134 of the porous media 130 via the liquid inlet interface 112. The evaporator 100 may be in heat receiving communication with a heat source. In various embodiments, the evaporator 100 may include a heat source interface 150 that facilitates the mechanical coupling between and/or promotes the heat transfer between the heat source and the housing 110 of the evaporator 100. In various embodiments, the porous media 130 is coupled to and/or mounted within the housing 110 so as to also be in heat receiving communication. In response to the heat transferring into the evaporator, the liquid flowing through conduit 134 may receive latent heat as at least a portion of the liquid undergoes a phase change (e.g., evaporates). The resultant vapor flows through the pores of the porous wall and exits the evaporator 100 through the vapor outlet interface 116.

In various embodiments, the liquid inlet interface 112, the liquid outlet interface 114, and the vapor outlet interface 116 are integrally formed and/or are unitary with the housing 110. In various embodiments, the liquid inlet interface 112, the liquid outlet interface 114, and the vapor outlet interface 116 are coupled to or mounted to the housing 110 using various attachment features, such as flange 115. The liquid inlet interface 112, the liquid outlet interface 114, and the vapor outlet interface 116 may be portions of tubing that extend between various other components of a heat exchanger system, such as the heat exchanger system 70 described below with reference to FIG. 4. In various embodiments, the liquid inlet interface 112, the liquid outlet interface 114, and the vapor outlet interface 116 are connections to which heat exchanger tubing and/or manifolds may be coupled.

The porous media 130 may have various shapes, geometries, and configurations. In various embodiments, the porous media 130 is cylindrical and the porous wall is a porous tube 132. In such embodiments, the conduit 134 may extend along a longitudinal centerline axis of the porous tube 132. The porous tube 132 may have an inlet end 136 that is coupled to the liquid inlet interface 112 and the porous tube 132 may have an outlet end 137 that is coupled to the liquid outlet interface 114. In various embodiments, the vapor outlet interface 116 may be disposed at or adjacent to one of the ends 136, 137 of the porous tube 132. In various embodiments, the vapor outlet interface may be disposed at other locations along the length of the porous tube 132. As mentioned above and according to various embodiments, the evaporator 100 may include multiple vapor outlet interfaces 116, 117. For example, the evaporator 100 may include a first vapor outlet interface 116 disposed adjacent the inlet end 136 of the porous tube 132 and a second vapor outlet interface 117 disposed adjacent the outlet end 137 of the porous tube 132.

The housing 110 may be made from various materials, such as metallic materials. In various embodiments, the housing 110 is constructed from materials that have high heat transfer properties, thereby facilitating the transfer of heat between the heat source (e.g., via the heat source interface 150) and the liquid flowing through the conduit 134. The porous media 130 may be made from various materials, such as ceramic materials, metallic materials, composite materials, etc. For example, the porous media 130 may be constructed from a monolithic ceramic material that has various radially outward surface features, as described below with reference to FIG. 2, which facilitate and direct vapor flow. In various embodiments, the porous media 130 is constructed from a metallic screen mesh or a metallic felt-like material. The porous media 130 may include multiple layers. In various embodiments, the porous media 130 is disposed relative to the housing 110 so that it is in direct physical contact with the housing 110 in order to promote efficient heat transfer (e.g., via conduction) between the housing 110 and the porous media 130.

In various embodiments, the pore size of the porous media 130 is between about 0.1 micrometers and about 20 micrometers. In various embodiments, the pore size of the porous media 130 is between about 0.5 micrometers and about 10 micrometers. In various embodiments, the pore size of the porous media 130 is between about 1 micrometer and about 5 micrometers. The size of the pores may be specifically configured for a specific application. For example, the size of the pores, together with the surface tension properties of the liquid, can affect the capillary action of the pores. Additionally, the pressure of the liquid in the conduit 134 and the vapor pressure of the vapor exiting through the vapor outlet interface 116 may affect the steady state operation of the evaporator 100.

Figure 2:
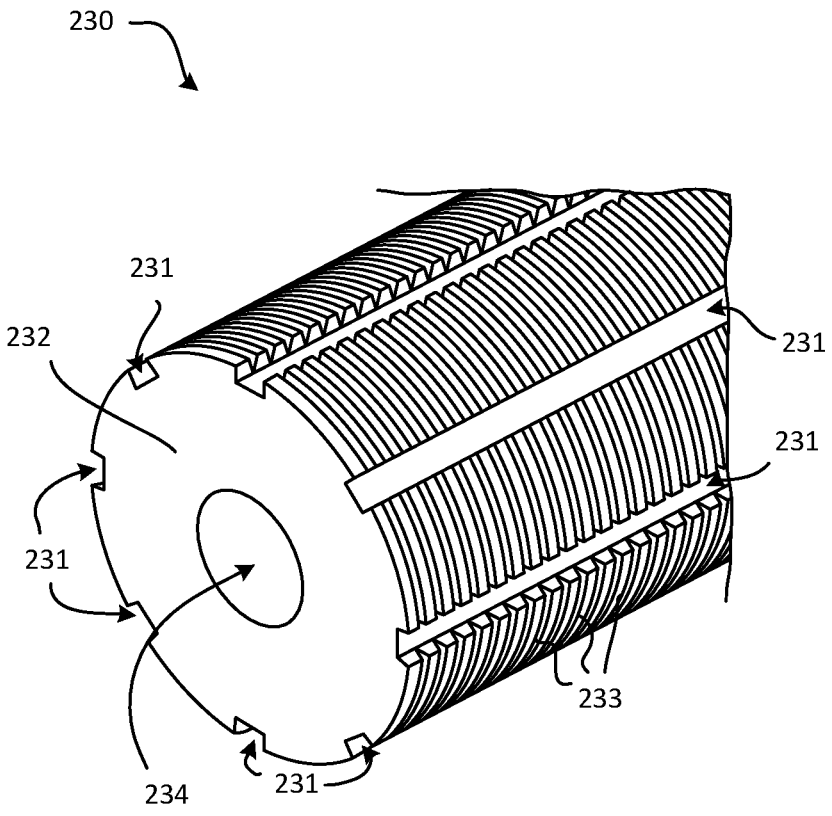
FIG. 2 illustrates a perspective view of a porous media, in accordance with various embodiments.

In various embodiments, and with reference to FIG. 2, the porous walls of the porous media 230 may have a tube-like geometry. The porous media 230 may have a radially inward surface that faces and borders the conduit 234 and a radially outward surface that has various features 231, 233 that facilitate and direct the flow of vapor. As mentioned above, the radially outward surface of the porous media 230 may be in direct contact with an internal surface of the housing 110. In various embodiments, the radially outward surface of the porous media 230 may have one or more longitudinally (e.g., axially) extending vapor vent channels 231. The longitudinally extending vapor vent channels 231 may be circumferentially distributed (e.g., may be circumferentially spaced apart from each other). The radially outward surface of the porous media 230 may include a plurality of circumferentially extending vapor grooves 233 that facilitate flow of the vapor towards the longitudinally extending vapor vent channels 231.

Figure 3A:
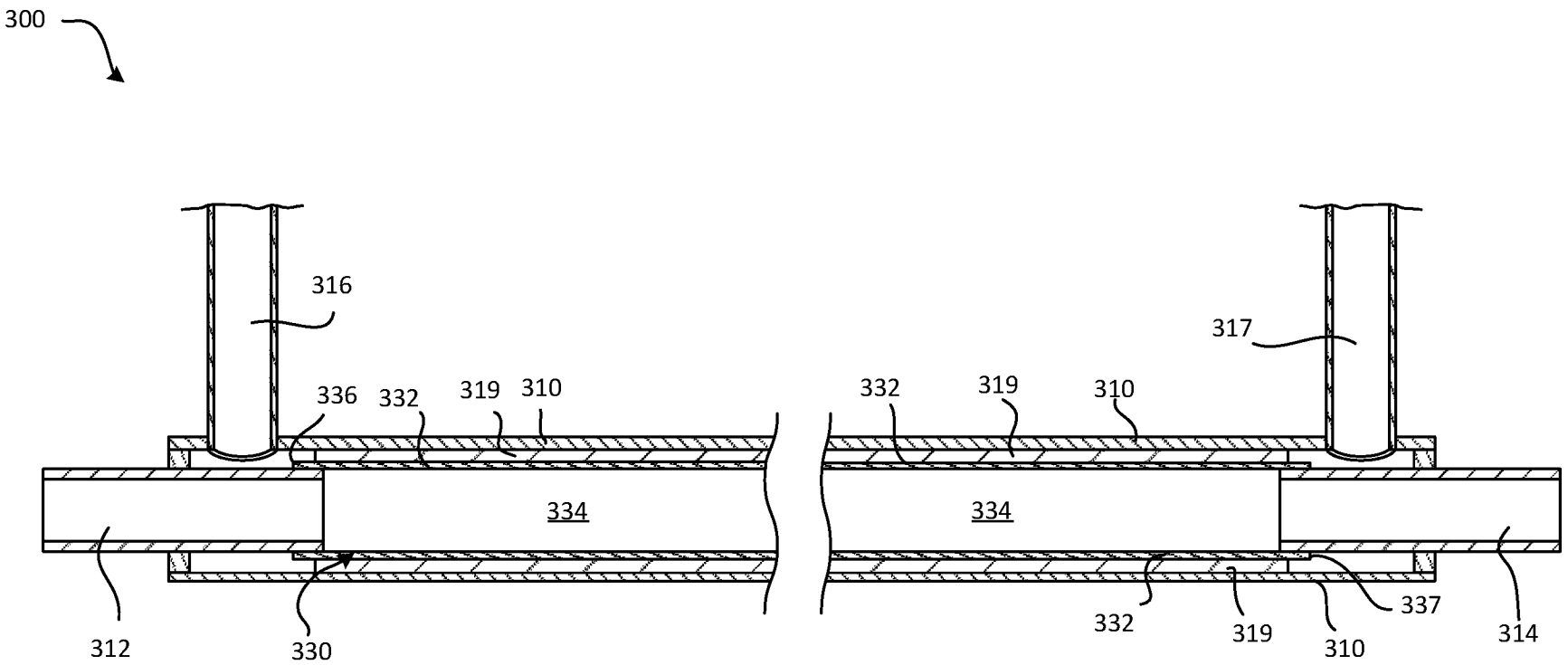
FIG. 3A illustrates a cross-sectional view of an evaporator, in accordance with various embodiments.

In various embodiments, and with reference to FIGS. 3A, 3B, and 3C, the evaporator 300 includes an internal surface of the housing 310 that includes a plurality of radially extending fins 319 that contact the radially outward surface of the porous media 330 (described in greater detail below). In various embodiments, the porous media 330 has a cylindrical shape and thus the porous wall is a porous tube 332 defining a cylindrical conduit 334. The inlet end 336 of the porous tube 332 may be coupled to the liquid inlet interface 312 and a first vapor outlet interface 316 may be disposed adjacent the inlet end 336 of the porous tube 332. The outlet end 337 of the porous tube 332 may be coupled to the liquid inlet outlet interface 314 and a second vapor outlet interface 317 may be disposed adjacent the outlet end 337 of the porous tube 332. In various embodiments, and with reference to FIGS. 3A, 3B and 3C, the inlet end 336 of the porous tube 332 overlaps at least a portion of the liquid inlet interface 312 and the outlet end 337 of the porous tube 332 overlaps at least a portion of the liquid outlet interface 314.

Figure 3B:
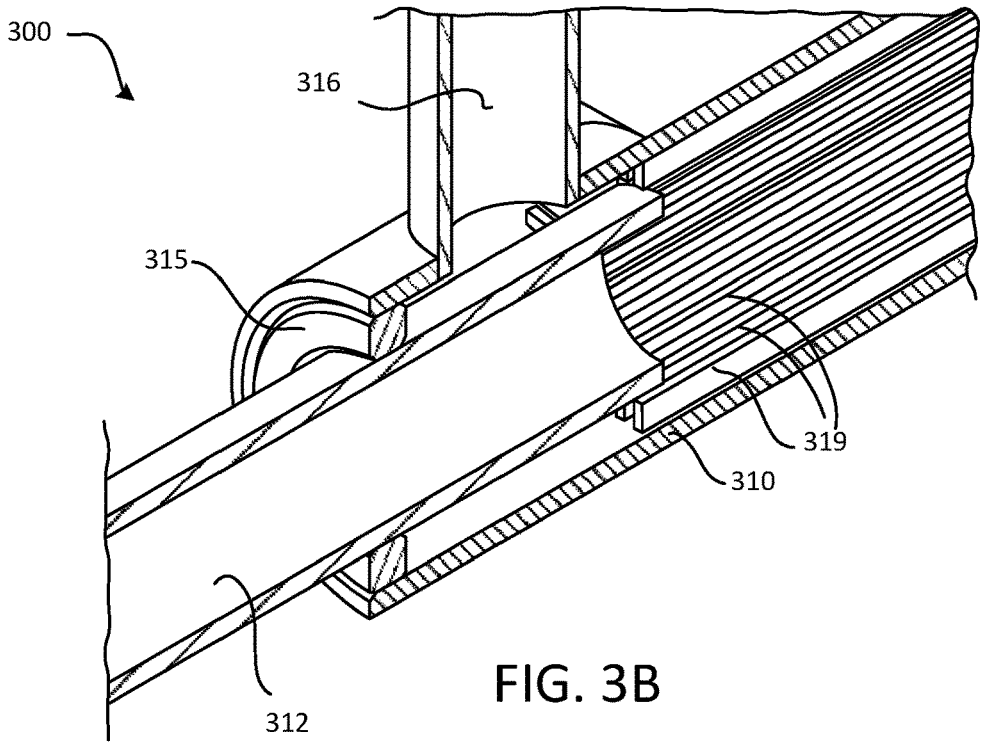
FIG. 3B illustrates a magnified view of an inlet end of the evaporator of FIG. 3A, but with the porous media not shown, in accordance with various embodiments.
Figure 3C:
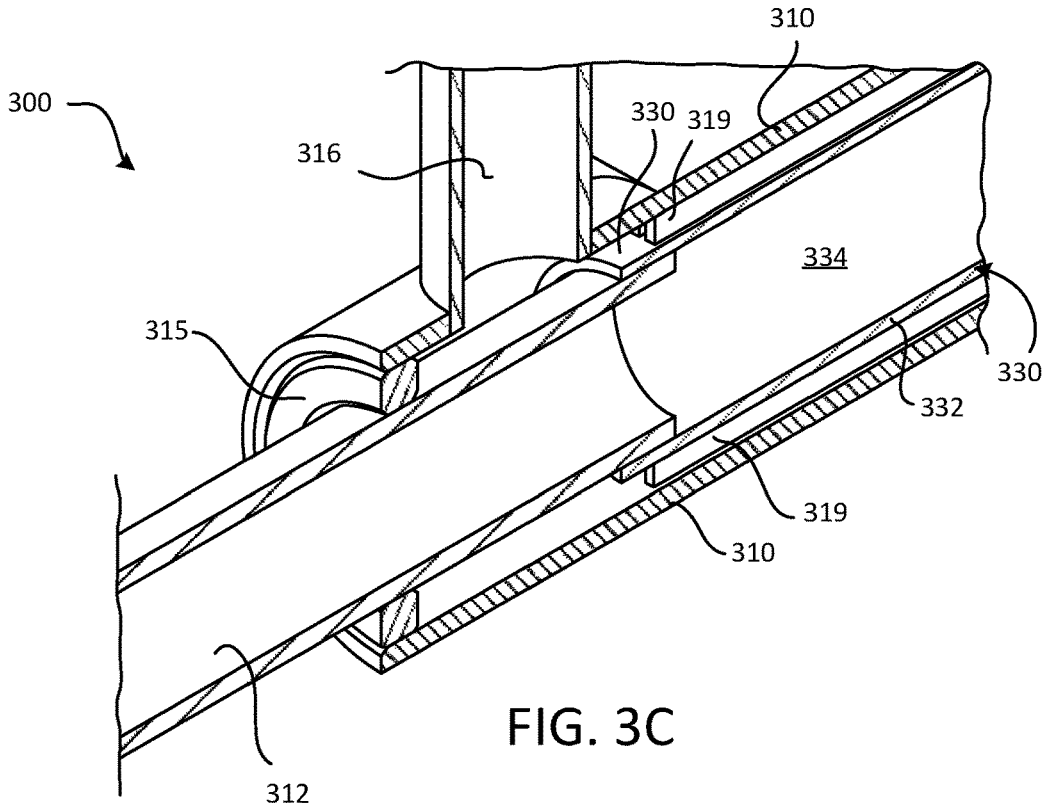
FIG. 3C illustrates a magnified view of the inlet end of the evaporator of FIG. 3A, in accordance with various embodiments.

FIGS. 3B and 3C illustrate magnified views of the inlet end of the evaporator 300. In FIG. 3B, the porous media 330 is not shown in order to provide a clear depiction of the radially extending fins 319 of the internal surface of the housing 310. FIG. 3C shows the porous media 330 in its installed/operational position, according to various embodiments. In such embodiments, vapor that passes through the pores of the porous media 330 is directed to flow between adjacent fins of the plurality of radially extending fins 319 towards the one or more vapor outlet interfaces 316, 317.

Figure 4:
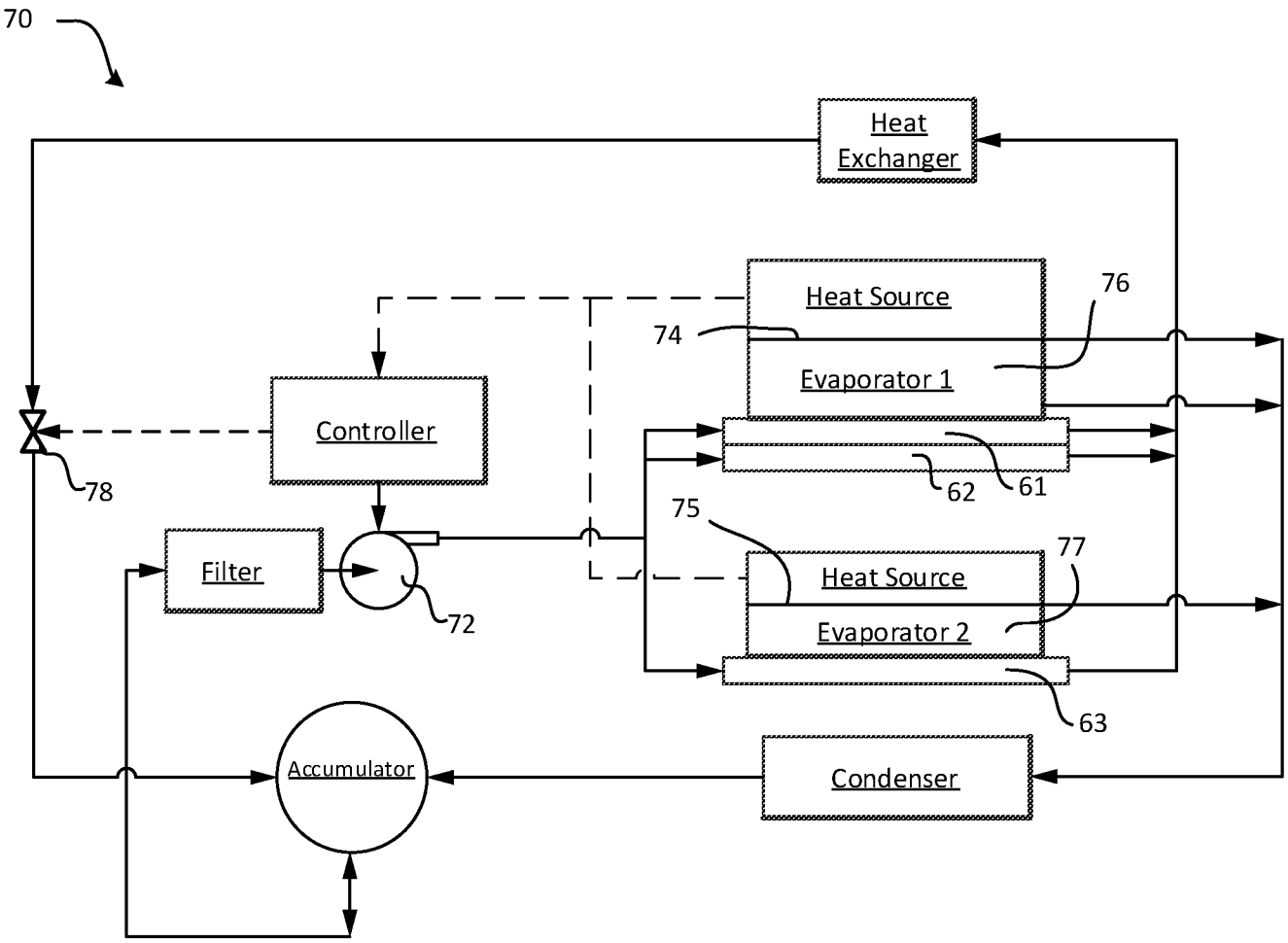
FIG. 4 illustrates a schematic block diagram of a heat exchanger system, in accordance with various embodiments.

In various embodiments, and with reference to FIG. 4, a heat exchanger system 70 is provided. The heat exchanger system 70 includes a pump 72 that is configured to pump liquid to one or more evaporators 76, 77, which may include the details of the evaporators 100, 300 described above. The evaporators 76, 77 may be connected in series or in parallel, and the evaporators 76, 77 may include on or more porous media units 61, 62. 63, which may comprise the details of the porous media 130, 230, 330 described above. The vapor that evaporates in the evaporators 76, 77 flows through a condenser heat exchanger, which condenses the vapor back to a liquid and the condensate may be directed to an accumulator for recirculation. The liquid that does not evaporate in the evaporators 76, 77 is directed to a heat exchanger where sensible heat is rejected. This non-evaporated liquid also flows through a valve 78 that controls the back-pressure of the evaporators 76, 77. The valve 78 may be controlled by a controller. The non-evaporated liquid may also be directed to an accumulator for recirculation by the pump 72. In various embodiments, the valve 78 that is downstream of the evaporators 76, 77 in the liquid line may be the exclusive source of control for the back-pressure of the evaporators 76, 77.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An evaporator comprising:

a housing comprising a first longitudinal end, a second longitudinal end opposite the first longitudinal end, a liquid inlet interface, a liquid outlet interface, a first vapor outlet interface, and a second vapor outlet interface; and a porous media disposed in the housing, the porous media comprising a porous wall and defining a conduit;

wherein:

the conduit defined in the porous media is in fluidic communication between the liquid inlet interface and the liquid outlet interface of the housing;

fluidic communication between the conduit defined in the porous media and the vapor outlet interface of the housing is through the porous wall of the porous media;

the porous wall is a porous tube having a longitudinal centerline axis;

the porous tube comprises an inlet end coupled to the liquid inlet interface and an outlet end coupled to the liquid outlet interface;

the housing comprises a first chamber defined between the first longitudinal end of the housing and the inlet end of the porous tube;

the housing comprises a second chamber defined between the second longitudinal end of the housing and the outlet end of the porous tube;

the first vapor outlet interface is fixed to the first chamber such that the first vapor outlet interface is disposed axially outward of, along the longitudinal centerline axis, the inlet end of the porous tube; and the second vapor outlet interface is fixed to the second chamber such that the second vapor outlet interface is disposed axially outward of, along the longitudinal centerline axis, the outlet end of the porous tube.

2. The evaporator of claim 1, wherein the porous wall comprises pores that have an average pore size diameter of between about 1.0 micrometer and about 5.0 micrometers.

3. The evaporator of claim 1, wherein the porous media is cylindrical and wherein the porous tube comprises a radially outward surface and a radially inward surface facing and bordering the conduit.

4. The evaporator of claim 3, wherein the porous tube comprises a porous ceramic material.

5. The evaporator of claim 4, wherein the conduit extends along a longitudinal centerline axis of the porous tube and the radially outward surface is in direct contact with an internal surface of the housing and comprises a longitudinally extending vapor vent channel.

6. The evaporator of claim 5, wherein the radially outward surface of the porous tube comprises a plurality of circumferentially extending vapor grooves.

7. The evaporator of claim 5, wherein the longitudinally extending vapor vent channel is one of a plurality of longitudinally extending vapor vent channels that are circumferentially distributed across the radially outward surface of the porous tube.

8. The evaporator of claim 5, wherein the longitudinally extending vapor vent channel is configured to direct vapor to the first vapor outlet interface and the second vapor outlet interface.

9. The evaporator of claim 3, wherein the radially outward surface of the porous tube is in direct contact with a plurality of radially extending fins of an internal surface of the housing, wherein vapor is configured to flow between adjacent fins of the plurality of radially extending fins to the first vapor outlet interface and the second vapor outlet interface.

10. The evaporator of claim 1, wherein the inlet end of the porous tube overlaps at least a portion of the liquid inlet interface and the outlet end of the porous tube overlaps at least a portion of the liquid outlet interface.

11. The evaporator of claim 1, further comprising a heat source interface coupled to the housing, wherein heat is configured to be conducted from the heat source interface through the housing to a liquid flowing through the conduit.

12. The evaporator of claim 1, wherein the liquid inlet interface extends through the first longitudinal end of the housing and the liquid outlet interface extends through the second longitudinal end of the housing.

13. A heat exchanger system comprising:

a pump;

a heat source interface;

an evaporator comprising:

a housing comprising a first longitudinal end and a second longitudinal end opposite the first longitudinal end;

a liquid inlet interface extending through the first longitudinal end of the housing and configured to be in liquid receiving communication with the pump;

a liquid outlet interface extending through the second longitudinal end of the housing;

a porous media housed within the housing, wherein the porous media comprises a porous wall and defines a conduit having a longitudinal centerline axis, wherein the conduit is disposed between the liquid inlet interface and the liquid outlet interface and the porous wall is configured to be in heat receiving communication with the heat source interface;

a first chamber defined between the first longitudinal end of the housing and an inlet end of the porous tube;

a second chamber defined between the second longitudinal end of the housing and an outlet end of the porous tube;

a first vapor outlet interface fixed to the first chamber, configured to be in vapor receiving communication with the porous wall, and disposed axially outward of, along the longitudinal centerline axis, the inlet end of the porous tube; and a second vapor outlet interface fixed to the second chamber, configured to be in vapor receiving communication with the porous wall, and disposed axially outward of, along the longitudinal centerline axis, the outlet end of the porous tube; and a valve downstream from the liquid outlet interface and configured to control back pressure in the evaporator.

14. The heat exchanger system of claim 13, wherein flow of vapor through the first vapor outlet interface and the second vapor outlet interface is configured to be controlled by the valve.

15. The heat exchanger system of claim 13, wherein the evaporator is one of a plurality of distinct evaporators, wherein the valve is configured to control back pressure in the plurality of evaporators.

* * * * *